US011079175B2

(12) United States Patent
Behringer

(10) Patent No.: US 11,079,175 B2
(45) Date of Patent: Aug. 3, 2021

(54) RETROFIT PELTIER DEVICE FOR COOLER

(71) Applicant: WiSys Technology Foundation, Inc., Madison, WI (US)

(72) Inventor: Brandon Joseph Behringer, Sturtevant, WI (US)

( * ) Notice: Subject to any disclaimer, the term of this patent is extended or adjusted under 35 U.S.C. 154(b) by 139 days.

(21) Appl. No.: 16/432,348

(22) Filed: Jun. 5, 2019

(65) Prior Publication Data

US 2019/0376739 A1 Dec. 12, 2019

Related U.S. Application Data

(60) Provisional application No. 62/681,487, filed on Jun. 6, 2018.

(51) Int. Cl.

| | |
|---|---|
| ***F25D 31/00*** | (2006.01) |
| ***F25D 25/02*** | (2006.01) |
| ***F25D 19/00*** | (2006.01) |
| ***F25B 21/02*** | (2006.01) |
| ***F25D 23/00*** | (2006.01) |

(52) U.S. Cl.

CPC ..... *F25D 31/007* (2013.01); *F25B 21/02* (2013.01); *F25D 19/003* (2013.01); *F25D 23/006* (2013.01); *F25D 25/028* (2013.01); *F25D 2400/12* (2013.01)

(58) Field of Classification Search

CPC .... F25D 31/007; F25D 25/028; F25D 19/003; F25D 23/006; F25D 2400/12; F25D 2331/805; F25B 21/02; F25B 2321/0251

USPC ..... 62/3.6

See application file for complete search history.

(56) References Cited

U.S. PATENT DOCUMENTS

| | | | | |
|---|---|---|---|---|
| 3,194,023 | A * | 7/1965 | Sudmeier | F25B 21/02 62/3.62 |
| 5,524,761 | A * | 6/1996 | Wayman | A45C 11/20 206/541 |
| 5,860,281 | A | 1/1999 | Coffee et al. | |
| 7,287,386 | B2 * | 10/2007 | Upadhye | A47J 36/2438 62/3.3 |
| 9,975,462 | B2 * | 5/2018 | Doi | B60N 3/104 |
| 10,145,592 | B2 * | 12/2018 | Liptak | F25D 31/007 |
| 10,231,561 | B2 * | 3/2019 | Lin | A47G 23/0241 |
| 2011/0083446 | A1 | 4/2011 | Pinet | |
| 2018/0141718 | A1 * | 5/2018 | Ahlstrom | B65D 25/2841 |

* cited by examiner

*Primary Examiner* — Ana M Vazquez

(74) *Attorney, Agent, or Firm* — Boyle Fredrickson S.C.

(57) ABSTRACT

A Peltier system can be retrofit to a standard cooler. A thermal conductive material passes between the cooler lip and the lid to provide a heat pipe communicating between opposed Peltier devices, a first device positioned within the cooler and pumping heat into the heat pipe and a second device positioned outside the cooler and removing heat from the heat pipe.

18 Claims, 2 Drawing Sheets

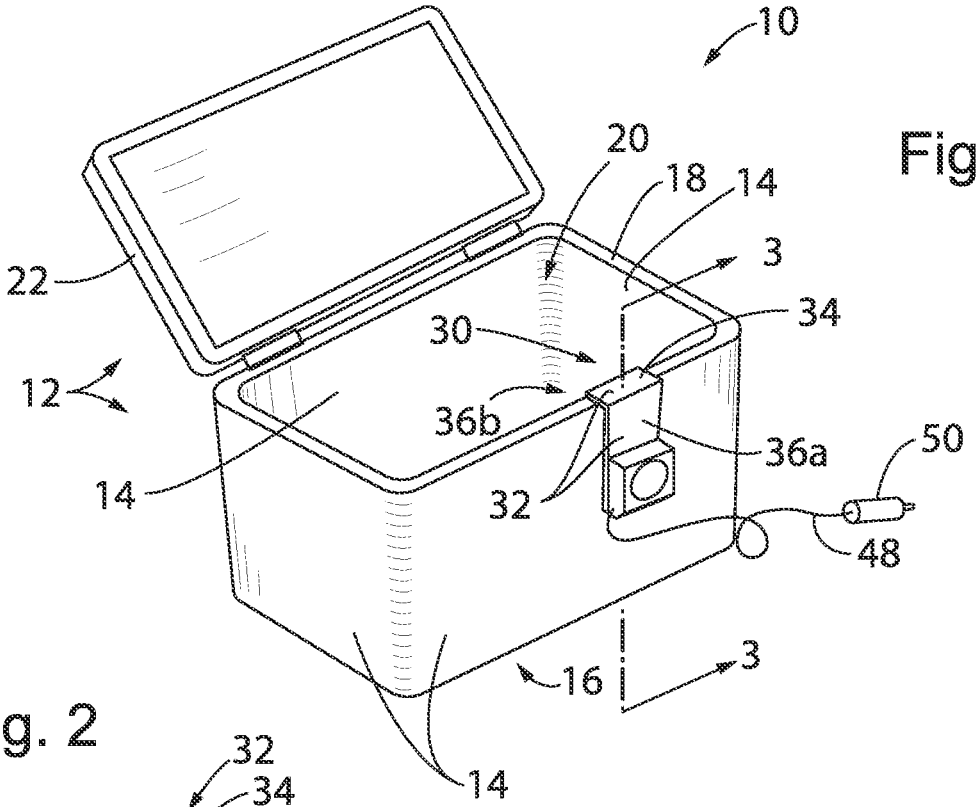
Fig. 1
Fig. 2
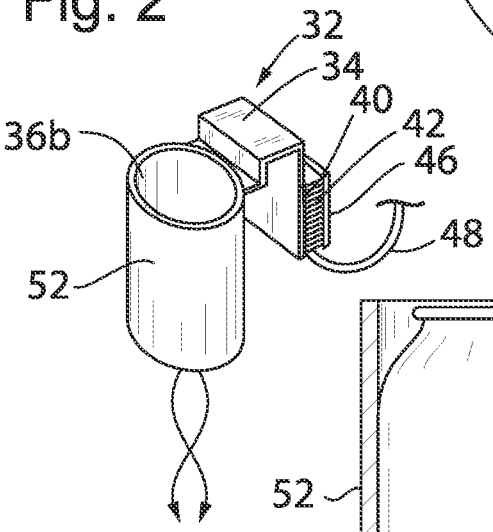
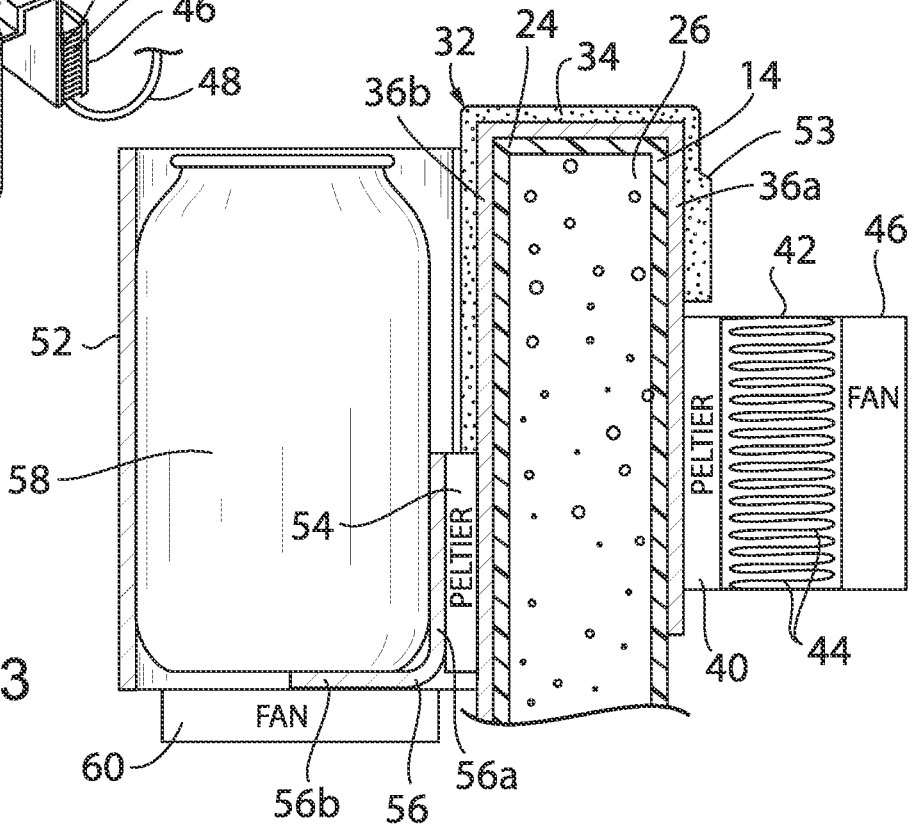
Fig. 3

RETROFIT PELTIER DEVICE FOR COOLER

STATEMENT REGARDING FEDERALLY SPONSORED RESEARCH OR DEVELOPMENT

--

CROSS REFERENCE TO RELATED APPLICATION

This application claims the benefit of U.S. Provisional Application No. 62/681,487, filed Jun. 6, 2018, hereby incorporated by reference.

BACKGROUND OF THE INVENTION

The present invention relates generally to insulated storage containers, for example, for receiving ice and beverages for cooling the beverages and in particular to a retrofit electrical cooling system for such storage containers eliminating the need for ice.

Insulated storage containers, often called "coolers," may hold ice and food or beverages to provide a convenient way of keeping food fresh and beverages chilled away from home.

It is known in the art to incorporate Peltier devices into such coolers to permit refrigeration capabilities when ice is not available or convenient. A Peltier device is a class of thermoelectric cooler and typically provides a semiconductor plate across which a voltage can be applied. Upon the application of voltage, heat is pumped from one side of the Peltier device (the cold side) to the other side (the hot side). The direction of the current determines the hot side and the cold side.

When such a filter device is incorporated into a cooler, an opening may be cut through a wall of the cooler and the Peltier device sealed within that opening with the hot side exposed outside of the cooler and the cold side exposed inside the cooler. In this way, when a voltage is applied to Peltier device, the interior temperature of the cooler may be reduced.

Generally, the hot and/or cold side of the Peltier device may be attached to heatsinks to aid in the transfer of heat between the Peltier device and ambient air. In addition, a fan may be used to circulate air across one or both of the hot and cold sides.

Such Peltier coolers are relatively expensive and increase the weight and complexity of the cooler even when thermoelectric cooling is not needed, for example, when ice is available.

SUMMARY OF THE INVENTION

The present invention provides a Peltier system that can be retrofit to a standard cooler. A thermal conductive material passes between the cooler lip and the lid to provide a heat pipe communicating between opposed Peltier devices, a first device positioned within the cooler and pumping heat into the heat pipe and a second device positioned outside the cooler and removing heat from the heat pipe. The Peltier devices can also be reversed by applying voltage in the opposite direction to remove heat from outside of the cooler and pump heat into the cooler.

The interior Peltier device may be placed in a cylinder to promote vortex flow as driven by a fan mounted at the bottom of the cylinder, thus increasing heat transfer.

In one embodiment, the present invention provides a cooling device for a beverage cooler having sidewalls terminating upwardly at a rectangular lip including a hanger having a horizontal heat conductor passable over the lip of the sidewalls of the beverage cooler, a first upwardly or downwardly extending vertical heat conductor passable upwardly or downwardly along an outer surface of the sidewall of the beverage cooler and a second downwardly extending vertical heat conductor passable downwardly along an inner surface of the sidewall of the beverage cooler; a first Peltier thermoelectric device supported by the first upwardly or downwardly extending vertical heat conductor; a second Peltier thermoelectric device supported by the second downwardly extending vertical heat conductor; a heat sink attached to at least one of the first and second Peltier thermoelectric devices; and a fan attached to the heat sink and forcing air through the heat sink.

It is thus a feature of at least one embodiment of the invention to provide a retrofit Peltier device that is adapted to fit over the edge of any standard beverage cooler without making any holes or openings in the walls of the beverage cooler.

A cylindrical shroud may thermally communicate with the second Peltier thermoelectric device. The cylindrical shroud may be sized to support a standard drink can.

It is thus a feature of at least one embodiment of the invention to provide rapid cooling to a beverage can supported by the cooling device and promoting heat transfer through the rest of the beverage cooler through an increased surface area of the beverage can.

Optionally, a second fan may pull air downwardly through the shroud to create a vortex for turbulent air flow.

It is thus a feature of at least one embodiment of the invention to promote cooling air flow through the beverage cooler even when a beverage can is not supported by the shroud.

Optionally, the second fan may be arranged to thermally communicate with the second Peltier thermoelectric device.

It is thus a feature of at least one embodiment of the invention to dissipate heat generating by the fan to the Peltier thermoelectric device.

A beverage cooler may provide an insulated container having four upstanding sidewalls positioned about a rectangular bottom and terminating upwardly at a rectangular lip surrounding an opening and a lid hingeably attached to the lip to cover the opening to provide an enclosed insulated volume within the four upstanding sidewalls. The horizontal heat conductor may have a thinness preventing interference with the lid when the lid is closed. The horizontal heat conductor may have a thickness of less than 3 mm.

It is thus a feature of at least one embodiment of the invention to provide a thin heat conductor that does not interfere with closure of the beverage cooler and preventing heat from escaping from the beverage cooler.

The horizontal heat conductor may have a cross sectional area of greater than 50 $mm^2$. The horizontal heat conductor may extend along the lip of the beverage cooler a length of at least 50 mm.

It is thus a feature of at least one embodiment of the invention to maintain a thin profile of the heat conductor while still allowing for sufficient heat transfer by increasing the length of the hanger along the lip of the beverage cooler.

The hanger may be a material having a minimum thermal conductivity of 200 W/m*K. The hanger may be a copper sheet. The hanger may be a pyrolytic graphite sheet.

It is thus a feature of at least one embodiment of the invention to provide sufficient heat transfer between the first and second Peltier thermoelectric devices over an upper edge of the cooler sidewall.

The hanger may be covered by thermal insulation where the first and second Peltier thermoelectric devices are not attached.

It is thus a feature of at least one embodiment of the invention to prevent heat leakage across the first and second Peltier thermoelectric devices over an exposed edge of the cooler sidewall.

The heatsink may have multiple fins adapted to exchange heat with the ambient air.

It is thus a feature of at least one embodiment of the invention to position the fins along the direction of normal air flow to enhance natural air convection.

Electrical wiring may communicate with at least one of the first and second Peltier thermoelectric devices and the fan and terminating at a standard automotive 12-volt connector.

It is thus a feature of at least one embodiment of the invention to allow the device to be used with an automobile 12-volt socket, such as during tailgates or outdoor car trips.

In an alternative embodiment, a method of cooling a beverage cooler includes providing a hanger having a horizontal heat conductor passable over a lip of a sidewall of the beverage cooler, a first upwardly or downwardly extending vertical heat conductor and a second downwardly extending vertical heat conductor; a first Peltier thermoelectric device supported by the first upwardly or downwardly extending vertical heat conductor; a second Peltier thermoelectric device supported by the second downwardly extending vertical heat conductor; a heat sink attached to at least one of the first and second Peltier thermoelectric devices; and a fan attached to the heat sink and forcing air through the heat sink; and installing the hanger over the lip of the sidewall of the beverage cooler such that the first upwardly or downwardly extending vertical heat conductor and the second downwardly extending vertical heat conductor flank the sidewall of the beverage cooler wherein the horizontal heat conductor has a thinness preventing interference with the lid when the lid is closed; and applying a voltage across the at least one of the first and second Peltier thermoelectric devices.

The method may include reversing the voltage (polarity) across the at least one of the first and second Peltier thermoelectric devices.

It is thus a feature of at least one embodiment of the invention to easily switch use of the container from a cooler to a portable heating device. Possible applications include drying clothes, thawing food, keeping fish bait at a desired temperature and the like.

These particular objects and advantages may apply to only some embodiments falling within the claims and thus do not define the scope of the invention.

BRIEF DESCRIPTION OF THE DRAWINGS

FIG. 1 is a perspective view of a generic cooler with the retrofit Peltier system of the present invention attached thereto showing the external Peltier device;

FIG. 2 a perspective view of the Peltier system of FIG. 1 from the opposite side showing an internal shroud for conducting air across an internal Peltier device;

FIG. 3 is a cross section taken along line 3-3 of FIG. 1; and

DETAILED DESCRIPTION OF THE PREFERRED EMBODIMENT

Figure 4:
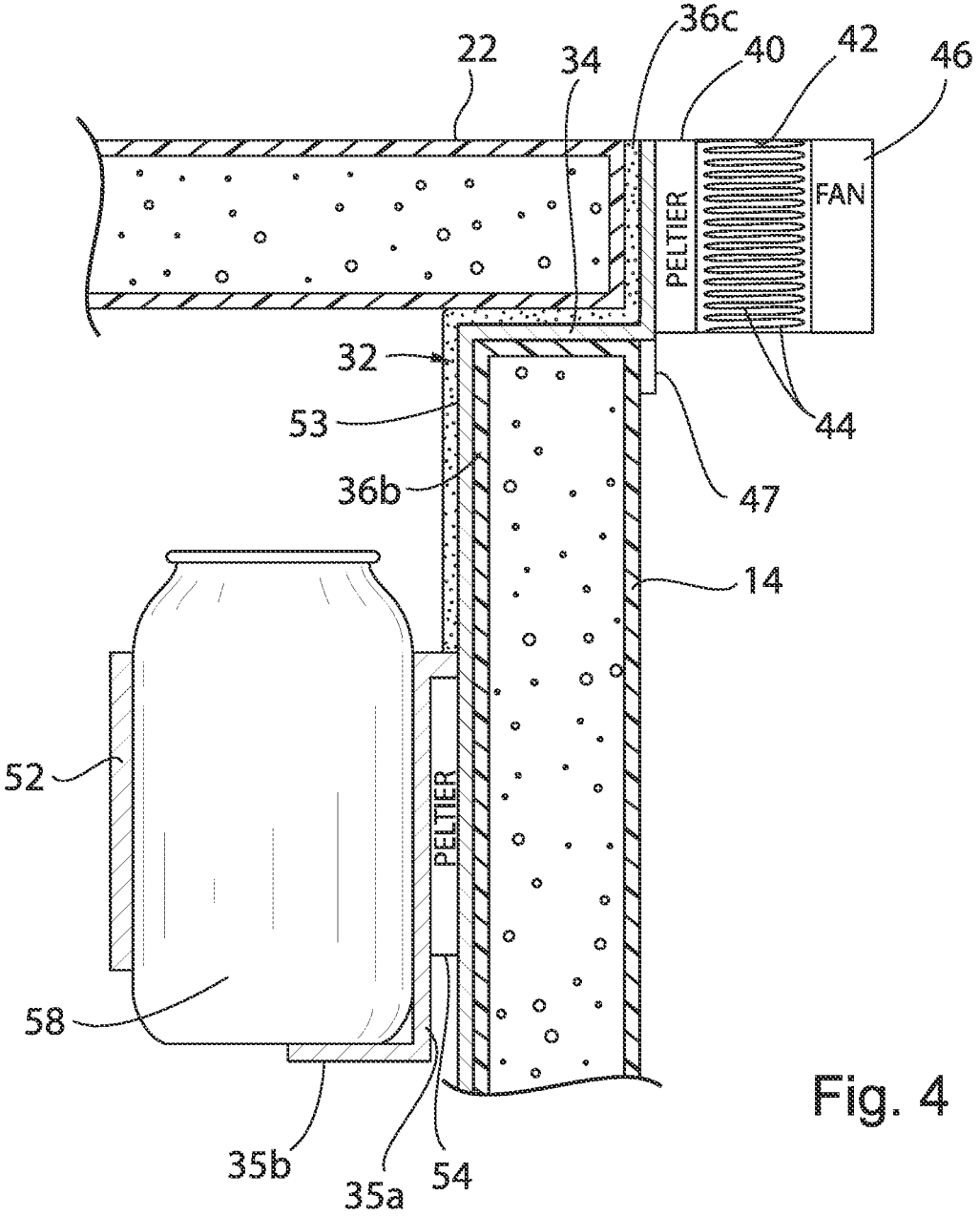
FIG. 4 is a cross-section of an alternative embodiment of the retrofit Peltier system having a collar forming a conductive "vapor chamber" around the drink can.

Referring now to FIG. 1, a cooler system 10 of the present invention may make use of a commercial, off-the-shelf cooler 12 providing an insulated container having four upstanding sidewalls 14 positioned about a rectangular bottom wall 16 and terminating upwardly at a rectangular lip 18 surrounding an opening 20.

A lid 22 is hingeably attached to the lip 18 at the rear edge of the opening 20 so as to swing over or away from the opening 20 and when closed to cover the opening 20 to provide an enclosed insulated volume within the upstanding sidewalls 14.

Referring momentarily to FIG. 3, each upstanding sidewall 14 may provide a plastic shell 24 forming opposed inner and outer sides of the upstanding walls 14 defining a space therebetween filled with a foam polymer material 26 for added insulation. The bottom wall 16 and the lid 22 may be constructed similarly.

Referring again to FIGS. 1 and 2, a retrofit Peltier system 30 may provide for a hanger 32 formed of a thin copper sheet or other highly conductive material such as flexible sheets of pyrolytic graphite having a horizontal heat conductor 34 passing horizontally over the lip 18 of a front sidewall 14 and having downwardly extending vertical heat conductors **36*a* and 36*b* passing downward along an outer surface of the front sidewall 14 and an inner surface of the front sidewall 14 respectively. The horizontal heat conductor 34 is thin enough so as to prevent interference between the lid 22 and the lip 18 allowing them to effectively seal when the lid 22 is closed. The horizontal heat conductor 34 and vertical heat conductors 36*a* and 36*b* of the hanger 32 may have a thickness of less than 10 mm or less than 5 mm or less than 3 mm. An arbitrary cross-sectional area, for example, greater than 50 $mm^2$, for heat transfer through the hanger 32 may be provided by extending the hanger horizontally over a greater portion of the lip 18 without necessarily making the hanger thicker such as might interfere with sealing of the lid 22 to the rim 18**.

The horizontal heat conductor 34 and vertical heat conductors **36*a* and 36*b* of the hanger 32** may be formed of a highly conductive material having a minimum thermal conductivity of 200 W/m*K or comparable to a metal such as copper or aluminum but desirably is a highly conductive material having a minimum thermal conductivity of 1000 W/m*K or greater and has a thermal conductivity greater than metals such as copper or aluminum.

Referring also to FIG. 3, vertical heat conductor **36*a* may attach to one broad surface of a Peltier thermoelectric device 40 whose opposite side attaches to an extruded aluminum heatsink 42 having multiple fins 44 for exchanging heat with the ambient air. The fins 44** may be alternatively oriented to extend vertically for convective cooling.

Positioned over the heatsinks 42 is a fan 46 forcing air through the fins 44 for improved heat transfer. Electrical wiring 48, for example, terminating at a standard automotive 12-volt connector 50 may provide electricity to the fan 46 and the Peltier thermoelectric device 40 biasing the latter so that the cold side of the Peltier thermoelectric device 40 is against the downwardly extending vertical heat conductor **36*a* and the hot side faces the heatsinks 42**.

Inside the cooler 12, the downwardly extending vertical heat conductor 36*b* may extend downwardly along a sidewall of a vertically oriented cylindrical metal shroud 60 providing a tube extending along the remainder of the downwardly extending vertical heat conductor 36*b*. Along the shroud 52, a second Peltier thermoelectric device 54 may be attached to the downwardly extending vertical heat conductor 36*b* and on the opposite side attached to a thin conductive plate 56 having a first downwardly extending portion 56*a* oriented vertically to contact the shroud 52 and a second horizontally extending portion 56*b* oriented horizontally. Optionally, a bottom of the cylindrical shroud 52 is fitted to a fan 60 pulling air downwardly through the shroud 52 to create a vortex for turbulent flow improving heat transfer and circulating cooled air through the interior of the cooler 12. The fan 60 contacts the second horizontally extending portion 56*b* of the thin conductive plate 56 to provide efficient heat transfer from the motor of the fan 60 to the Peltier thermoelectric device 54.

A standard drink can 58 having a base diameter of 2 inches to 3 inches may be positioned within the cylindrical shroud 52, the shroud 52 having a diameter slightly larger than the drink can 58, for example, 2.5 inches to 3.5 inches. The drink can 58 may be in direct contact with the thin conductive plate 56 to provide efficient heat transfer from the drink can 58 to the Peltier thermoelectric device 54 to cool the drink can 58.

Thermal insulation 53 may cover the exposed upper surface of the horizontal heat conductor 34 and portions of the downwardly extending vertical heat conductor 36*b* outside the region of contact of the Peltier device 54. Again, the electrical wiring 48 may provide for power to the fan 60 and to the Peltier thermoelectric device 54 which is biased so that its cold side is toward the conductive plate 56 and its hot side is toward the downwardly extending vertical heat conductor 36*a*.

It will be appreciated that the hanger 32 provides a path of heat flow out of the cooler 12 when the lid 22 is closed, the hanger 32 being thin enough to prevent interference with the lid 22 and allowing the pumping of heat without making holes in the walls 14 of the cooler or the lid 22.

It will be appreciated that the two Peltier thermoelectric devices 40 and 54 may be of different sizes with a smaller Peltier thermoelectric device 54 used on the interior of the cooler 12. It will be appreciated that the two Peltier thermoelectric devices 40 and 54 may be of the same size running at a lower voltage.

Referring now to FIG. 4, an alternative embodiment of the retrofit Peltier system 30 may provide for a hanger 32 formed of a thin copper sheet or other highly conductive material having a horizontal heat conductor 34 passing horizontally over the lip 18 of a front side wall 14 and having an upwardly extending vertical heat conductor 36*c* passing upward along an outer surface of the lid 22 when the lid 22 is closed, and a downwardly extending vertical heat conductor 36*b* passing downward along an inner surface of the front side wall 14 of the cooler 12.

The upwardly extending vertical heat conductor 30*c* attaches to the first Peltier thermoelectric device 40 whose opposite side attaches to an extruded aluminum heatsink 42 having multiple fins 44 for exchanging heat with the ambient air. Positioned over the heatsink 42 is a fan 46 forcing air through the fins 44 for improved heat transfer.

A front end of the lid 22 abuts the upwardly extending vertical heat conductor 36*c* to retain the hanger 32 on the lip 18 of the front side wall 14 when the lid 22 is in a close position. The weight of the upwardly extending vertical heat conductor 30*c* and the first Peltier thermoelectric device 40, fins 44, and fan 46 may assist to retain the hanger 32 on the lip 18 of the front side wall 14 when the lid 22 is in an open position, or a downwardly extending vertical clip 47 may extend along the outer surface of the of the front side wall 14 to help retain the hanger 32 on the front side wall 14.

Inside the cooler 12, the downwardly extending vertical heat conductor 36*b* may jog inwardly to provide a vertically oriented cylindrical metal shroud 52 or "vapor chamber" providing a tube or collar surrounding a body of the drink can 58. A bottom of the shroud 52 may provide a downwardly extending vertical heat conductor 35*a* passing downward along the outer surface of the drink can 58 to a horizontal heat conductor 35*b* at a lower end passing horizontally below the drink can 58 to support a bottom of the drink can 58.

Outside of the shroud 52, between the shroud 52 and the inner surface of the front side wall 14 of the cooler 12, the second Peltier thermoelectric device 54 may be attached to the downwardly extending vertical heat conductor 36*b* and an outer surface of the shroud 52 to provide a path of heat flow from the drink can 58 to the shroud 52 to the second Peltier thermoelectric device 54 and to the downwardly extending vertical heat conductor 36*b* of the hanger 32.

The shroud 52 and the vertical heat conductor 35*a* and horizontal heat conductor 35*b* may form a "vapor chamber" conducting heat from the drink can 50 to the second Peltier thermoelectric device 54. The exposed upper opening of the shroud 52 allows for the drink can 58 to be easily removed by sliding the drink can 50 upward in a vertical direction outward from the shroud 52 while the vertical heat conductor 35*a* and horizontal heat conductor 35*b* support the drink can 50 on a lower end when the drink can 50 is placed within the shroud 52.

Thermal insulation 53 may cover the exposed upper surface of the horizontal heat conductor 34 and portions of the downwardly extending vertical heat conductor 36*b* and upwardly extending vertical heat conductor 36*c* outside the region of contact of the first Peltier thermoelectric device 40 and second Peltier thermoelectric device 54.

It is understood that the shroud 52 may be sized to carry one or more drink cans 50 and may be shaped, for example, in a figure-8 to increase direct contact of two or more drink cans with the shroud 52.

It is understood that in all other respects the alternative embodiment shown in FIG. 4 will coincide with the embodiment described above with respect to FIGS. 1-3.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What I claim is:

1. A cooling device for a beverage cooler having sidewalls terminating upwardly at a rectangular lip comprising:

a hanger having a horizontal heat conductor passable over the lip of the sidewalls of the beverage cooler, a first upwardly or downwardly extending vertical heat conductor passable upwardly or downwardly along an outer surface at least one of the sidewalls of the beverage cooler and a second downwardly extending vertical heat conductor passable downwardly along an inner surface of the at least one of the sidewalls of the beverage cooler;

a first Peltier thermoelectric device providing a first semiconductor plate across which a voltage is applied supported by the first upwardly or downwardly extending vertical heat conductor;

a second Peltier thermoelectric device providing a second semiconductor plate across which the voltage is applied supported by the second downwardly extending vertical heat conductor;

a heat sink attached to at least one of the first and second Peltier thermoelectric devices; and a fan attached to the heat sink and forcing air through the heat sink.

2. The device of claim 1 further comprising a cylindrical shroud arranged to thermally communicate with the second Peltier thermoelectric device.

3. The device of claim 2 wherein the cylindrical shroud is sized to support a standard drink can.

4. The device of claim 2 further comprising a second fan arranged to pull air downwardly through the cylindrical shroud to create a vortex for turbulent air flow.

5. The device of claim 4 wherein the second fan is arranged to thermally communicate with the second Peltier thermoelectric device.

6. The device of claim 1 further comprising the beverage cooler providing an insulated container wherein the sidewalls of the beverage cooler comprise four upstanding sidewalls positioned about a rectangular bottom and terminating upwardly at the rectangular lip surrounding an opening and a lid hingeably attached to the rectangular lip to cover the opening to provide an enclosed insulated volume within the four upstanding sidewalls.

7. The device of claim 6 wherein the horizontal heat conductor has a thinness preventing interference with the lid when the lid is closed over the opening.

8. The device of claim 7 wherein the horizontal heat conductor has a thickness of less than 3 mm.

9. The device of claim 7 wherein the horizontal heat conductor has a cross sectional area of greater than 50 $mm^2$.

10. The device of claim 7 wherein the horizontal heat conductor extends along the rectangular lip of the beverage cooler a length of at least 50 mm.

11. The device of claim 1 wherein the hanger is a material having a minimum thermal conductivity of 1000 W/m*K.

12. The device of claim 11 wherein the hanger is a copper sheet.

13. The device of claim 11 wherein the hanger is a pyrolytic graphite sheet.

14. The device of claim 1 wherein the hanger is covered by thermal insulation where the first and second Peltier thermoelectric devices are not attached.

15. The device of claim 1 wherein the heat sink has multiple fins adapted to exchange heat with ambient air.

16. The device of claim 1 further comprising electrical wiring communicating with at least one of the first and second Peltier thermoelectric devices and the fan and terminating at a standard automotive 12-volt connector.

17. A method of cooling a beverage cooler having sidewalls terminating upwardly at a rectangular lip and a lid hingeably attached to the rectangular lip to provide an enclosed insulated volume within the sidewalls comprising:

providing a hanger having a horizontal heat conductor passable over the rectangular lip of the sidewalls of the beverage cooler, a first upwardly or downwardly extending vertical heat conductor and a second downwardly extending vertical heat conductor; a first Peltier thermoelectric device supported by the first upwardly or downwardly extending vertical heat conductor; a second Peltier thermoelectric device supported by the second downwardly extending vertical heat conductor; a heat sink attached to at least one of the first and second Peltier thermoelectric devices; and a fan attached to the heat sink and forcing air through the heat sink; and installing the hanger over the rectangular lip of at least one of the sidewalls of the beverage cooler such that the first upwardly or downwardly extending vertical heat conductor and the second downwardly extending vertical heat conductor flank the at least one of the sidewalls of the beverage cooler wherein the horizontal heat conductor has a thinness preventing interference with the lid when the lid is closed; and applying a voltage across the at least one of the first and second Peltier thermoelectric devices.

18. The method of claim 17 further comprising:

reversing a direction of current across the at least one of the first and second Peltier thermoelectric devices.

* * * * *